US010527248B2

(12) United States Patent
Taudt et al.

(10) Patent No.: US 10,527,248 B2
(45) Date of Patent: Jan. 7, 2020

(54) LIGHTING DEVICE FOR A MOTOR VEHICLE HEADLIGHT

(71) Applicant: ZKW Group GmbH, Wieselburg (AT)

(72) Inventors: Lukas Taudt, Wieselburg (AT); Udo Maier, Herzogenburg (AT)

(73) Assignee: ZKW GROUP GMBH, Wieselburg (AT)

( * ) Notice: Subject to any disclaimer, the term of this patent is extended or adjusted under 35 U.S.C. 154(b) by 90 days.

(21) Appl. No.: 15/762,855

(22) PCT Filed: Aug. 19, 2016

(86) PCT No.: PCT/AT2016/060033

§ 371 (c)(1),
(2) Date: Mar. 23, 2018

(87) PCT Pub. No.: WO2017/054020

PCT Pub. Date: Apr. 6, 2017

(65) Prior Publication Data

US 2018/0292061 A1 Oct. 11, 2018

(30) Foreign Application Priority Data

Sep. 30, 2015 (AT) ..... 50825/2015

(51) Int. Cl.
*F21S 41/24* (2018.01)
*F21S 41/143* (2018.01)
(Continued)

(52) U.S. Cl.
CPC ..... *F21S 41/24* (2018.01); *F21S 41/143* (2018.01); *F21S 41/25* (2018.01); *F21S 41/255* (2018.01);
(Continued)

(58) Field of Classification Search
None
See application file for complete search history.

(56) References Cited

U.S. PATENT DOCUMENTS 9,689,545 B2 6/2017 Wintzer et al.
9,851,065 B2 12/2017 Taudt et al.
(Continued)

FOREIGN PATENT DOCUMENTS

AT 11129 U1 5/2010
AT 507679 A4 7/2010
(Continued)

OTHER PUBLICATIONS

International Search Report for PCT/AT2016/060033, dated Nov. 18, 2016 (2 pages).
(Continued)

*Primary Examiner* — Elmito Breval
(74) *Attorney, Agent, or Firm* — Eversheds Sutherland (US) LLP

(57) ABSTRACT

The invention relates to a lighting device (1*a*) for a motor vehicle headlight, comprising a first light-guide (2) unit having a retaining bar (2*a*) and at least two outcoupling bars (2*b*) arranged at least at a distance from one another and protruding from the retaining bar (2*a*), a second light-guide unit (3) having a retaining bar (3*a*) and at least one outcoupling bar (3*b*) protruding from the retaining bar (3*a*), a number of light sources (4) for coupling light into the outcoupling bars (2*b*, 3*b*) of the light-guide units (2,3), wherein at least one light source (4) is associated with each outcoupling bar (2*b*, 3*b*), and comprising at least one lens (5), preferably a projection lens, arranged after the light-guide units (2, 3) for generating a light distribution, wherein each outcoupling bar (2*b*, 3*b*) has a light-outcoupling surface (2*c*, 3*c*) for emitting light into the at least one lens (5), wherein the first and the second light-guide units (2, 3) are
(Continued)

separate components from one another, which are arranged in relation to one another in such a way that a respective outcoupling bar (3*b*) of the second light-guide unit (3) is arranged between neighbouring outcoupling bars (2*b*) of the first light-guide unit (2), and wherein an aperture (11) is arranged between the lens (5) and the light-outcoupling surfaces (2*c*, 3*c*) of the outcoupling bars (2*b*, 3*b*).

18 Claims, 5 Drawing Sheets

(51) Int. Cl.

| | |
|---|---|
| ***F21S 41/663*** | (2018.01) |
| ***F21S 41/29*** | (2018.01) |
| ***F21S 41/43*** | (2018.01) |
| ***F21S 41/255*** | (2018.01) |
| ***F21S 41/25*** | (2018.01) |
| *F21Y 105/10* | (2016.01) |
| *F21S 41/40* | (2018.01) |

(52) U.S. Cl.
CPC ..... *F21S 41/29* (2018.01); *F21S 41/43* (2018.01); *F21S 41/663* (2018.01); *F21S 41/40* (2018.01); *F21Y 2105/10* (2016.08)

(56) References Cited

U.S. PATENT DOCUMENTS

| | | | | |
|---|---|---|---|---|
| 9,879,835 | B2 | 1/2018 | Taudt et al. | |
| 2009/0016074 | A1 | 1/2009 | Dolson et al. | |
| 2014/0204602 | A1 | 7/2014 | Jungwirth et al. | |
| 2015/0124469 | A1* | 5/2015 | Krenn | G02B 6/0068 362/511 |
| 2015/0226395 | A1* | 8/2015 | Taudt | F21S 41/24 362/511 |
| 2015/0323146 | A1* | 11/2015 | Krenn | G02B 6/0078 362/511 |
| 2016/0273730 | A1 | 9/2016 | Maier et al. | |

FOREIGN PATENT DOCUMENTS

| | | | |
|---|---|---|---|
| EP | 2306074 | A2 | 9/2015 |
| JP | H10119637 | A | 5/1998 |

OTHER PUBLICATIONS

Search Report issued in Austrian Application No. A 50825/2015, completed Aug. 1, 2016 (1 page).

* cited by examiner

LIGHTING DEVICE FOR A MOTOR VEHICLE HEADLIGHT

The invention relates to a lighting device for a motor vehicle headlight, comprising a first light-guide unit having a retaining bar and at least two outcoupling bars arranged at a distance from one another and protruding from the retaining bar, a second light-guide unit having a retaining bar and at least one outcoupling bar protruding from the retaining bar, a number of light sources for coupling light into the outcoupling bars of the light-guide units wherein at least one light source is associated with each outcoupling bar, and comprising at least one lens, preferably a projection lens, arranged after the light-guide units for generating a defined light distribution, wherein each outcoupling bar has a light-outcoupling surface for emitting light into the at least one lens, wherein the first and the second light-guide units are separate components from one another, which are arranged in relation to one another in such a way that a respective outcoupling bar of the second light-guide unit is arranged between neighbouring outcoupling bars of the first light-guide unit.

The invention further relates to motor vehicle headlights having at least one lighting device according to the invention, and a motor vehicle comprising at least one, preferably two lighting devices and/or motor vehicle headlights.

The lighting devices mentioned above are used in light modules for motor vehicle headlights for generating light distributions, for example, for generating segmented light distributions, i.e. light distributions composed of individual light segments. Such a light segment, for example, may be illuminated by actuating a light source associated with an outcoupling bar, wherein the light coupled into the outcoupling bar is projected as a light segment via a downstream lens, onto, e.g., an area in front of the lighting device, such as a roadway.

In order to generate a light distribution as homogeneous as possible, it is desirable to arrange the individual outcoupling bars as close as possible to one another. However, for manufacturing reasons, narrow gap widths between the outcoupling bars of a light-guide unit may not be economically manufactured but to a limited extent. Therefore, it has become common to provide two or more light-guide units having outcoupling bars slidable into one another such that the outcoupling bar of one light-guide unit is received between outcoupling bars of the opposite light-guide unit, enabling narrower gap widths between the outcoupling bars to be manufactured economically. Such light-guide units have become known from the document WO 2014/202177 A1, for example, where outcoupling bars—there referred to as auxiliary optical systems—are arranged on two opposite light-guide units.

The disadvantage of providing light-guide units engaging one another or cooperating for a common light distribution, respectively, is that they may be positioned incorrectly to one another, wherein experience has shown that incorrect light-guide unit positioning will be visible in the light image of such a lighting device. This particularly involves the shape of the bottom edge of a light distribution emitted by the lighting device corresponding to the shape of a rectangular function with the light-guide units being offset to one another.

Therefore, efforts have been made to minimise errors in positioning the light-guide units to one another. These efforts have provided only partly satisfactory results as, due to the multi-component, partly nested structure of the lighting device, tolerances of individual components may not be arbitrarily reduced without significantly complicating the assembly of the lighting device and/or considerably increasing the manufacturing costs of the individual components.

Therefore, it is an object of the invention to create a lighting device which allows to continue utilizing the advantage of providing light-guide units cooperating with one another while preventing the disadvantages mentioned above, particularly undesired projection errors.

This object is achieved through a lighting device of the type mentioned above by arranging an aperture between the lens and the light-outcoupling surfaces of the outcoupling bars, according to the invention, configured to limit light emitted/exiting from the outcoupling bars towards the lens such that the light distribution emitted by the lighting device is limited downwards by a single continuous straight bottom edge, preferably in the form of a horizontal line.

Due to the invention, errors in positioning the light-guide units in a vertical direction may be compensated such that the light distribution emitted by the lighting device is limited by a single, sharp, continuous bottom edge. For example, the bottom edge is located 2° below the horizontal line of the light distribution.

The first and/or the second light-guide units do not need to be formed integrally, but may also be composed of multiple light-guide units. The aperture is made of an opaque material. Preferably, the lighting device is configured to generate a low beam distribution or a high beam distribution, particularly an adaptive low beam distribution or high beam distribution.

Alternatively, the outcoupling bars may be implemented separately—meaning that only one outcoupling bar is associated with each light-guide unit. In such an arrangement, providing retaining bars could be spared. Here, the aperture would have the same effect, however, the manufacturing efforts for realising such an arrangement are disproportionally extensive.

In particular, the aperture may be provided as having a horizontal edge for limiting the light distribution.

In order to achieve the light distribution being limited on all sides, the aperture may be provided as having an opening through which light from the outcoupling bars is guided into to the lens, wherein, when installed, an upper side of the opening is limited by a horizontal edge.

Preferably, the aperture may be implemented integrally.

In particular, the first light-guide unit may be provided as comprising a number of n outcoupling bars protruding from the retaining bar, the second light-guide unit comprising a number of n−1 outcoupling bars protruding from the retaining bar, preferably wherein n=3, n=4, or n≥5. In that example of the invention, the first light-guide always comprises one more outcoupling bar than the second light-guide unit. By increasing the number of outcoupling bars, a finer resolution may be achieved.

In an alternative embodiment, the first and second light-guide units comprise the same number of outcoupling bars. Here, the first light-guide unit comprises a number of n outcoupling bars protruding from the retaining bar, while the second light-guide unit comprises a number of n outcoupling bars protruding from the retaining bar, preferably wherein n=3, n=4, or n≥5.

Also, the first and/or second light-guides unit may be provided as being implemented as transparent solid bodies. Light is guided within the solid bodies through total reflection along their walls.

Alternatively, the first and/or second light-guide units may be provided as being implemented as light-guiding hollow bodies.

Associating at least one LED light source with each outcoupling bar may be particularly advantageous. Also, two or more LEDs may be associated with each outcoupling bar.

In order to pre-set the light emitted by the outcoupling bars and subsequently segmenting the light distribution in a particularly precise manner, some, preferably all, of the light sources associated with the outcoupling bars may be provided as being actuated individually to generate a dynamic light distribution.

Another aspect of the invention relates to a motor vehicle headlight comprising at least one lighting device according to the invention, and to a motor vehicle comprising at least one, preferably two lighting devices and/or motor vehicle headlights according to the invention.

The invention will be discussed below in more detail based on an exemplary and not limiting embodiment illustrated in the figures, where FIG. 1 shows a schematic view of a lighting device according to the prior art, and FIG. 1*a* shows a detailed view of FIG. 1;

FIG. 1*a* shows a detailed view of a beam path through light-guide units of FIG. 1;

If not stated otherwise, the same features will be indicated by the same reference numerals throughout the figures.

Figure 1:
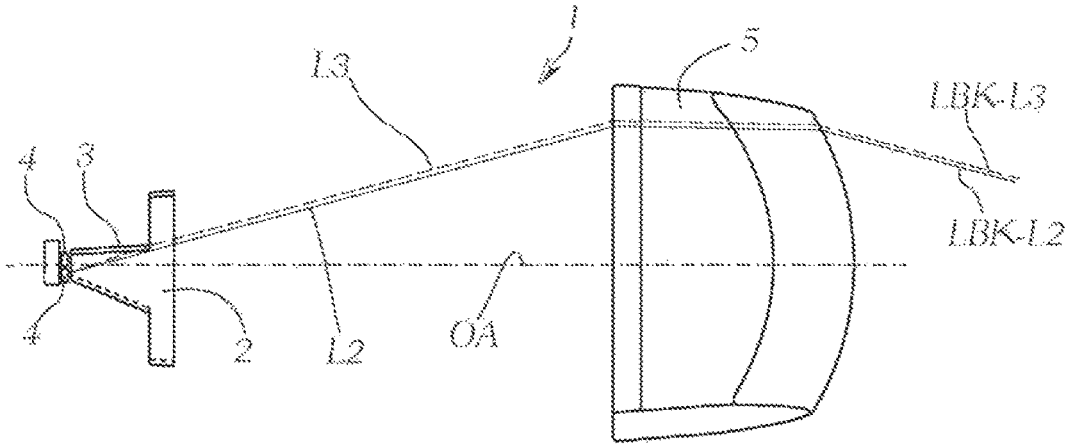

FIG. 1 shows a schematic view of a lighting device 1 according to the prior art. The lighting device 1 is adapted for use in a motor vehicle headlight and comprises a first light-guide unit 2 and a second light-guide unit 3, the first light-guide unit 2 almost completely covering the second light-guide unit 3 in this perspective view.

Figure 1A:
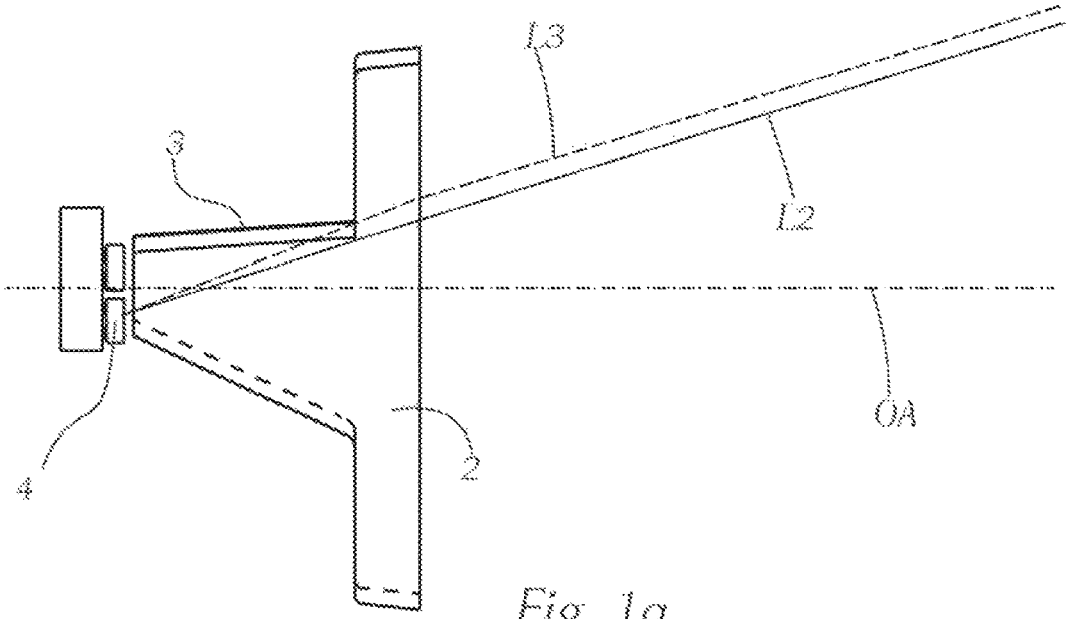

The light-guide units 2 and 3 are configured to guide light being coupled into the light-guide unit 2 or 3 via upstream light sources 4 into a downstream lens 5. The light-guide units 2 and 3 are aligned respectively to the optical axis OA of the lens 5 for guiding light into the lens 5. Due to various mounting inaccuracies and/or manufacturing tolerances that will be discussed further below in more detail with reference to FIGS. 3-6, in that instance, the light-guide units 2 and 3 may be offset from one another in a vertical direction such that a bottom edge of the light distribution of the light image generated by the lighting device will be stepped. In this case, the second light-guide unit 3 has an upward offset and the first light-guide unit 2 has a downward offset, whereby an edge ray L3 outcoupled by the second light-guide 3 has an offset to the edge ray L2 outcoupled by the first light-guide unit 2. Here, an edge ray refers to a ray of light located in the outermost edge region of the solid angle illuminated by a light-guide unit 3 and thus setting the limits of the light distribution. If not stated otherwise, all indications of direction refer to the lighting device when mounted. FIG. 1*a* shows a detailed view of the light-guide units 2 and 3 offset to one another and the exemplary edge rays L2 and L3.

Figure 2:
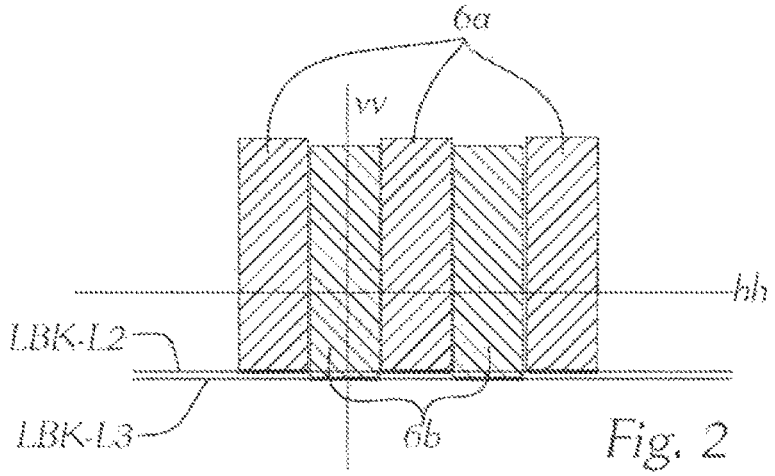
FIG. 2 shows a schematic view of multiple light segments generated by the lighting device of FIG. 1.

FIG. 2 shows the effects of offsetting the light-guide units 2 and 3 to one another. The first light-guide unit 2 projects individual light segments 6*a*; the remaining light segments 6*b* originate from the second light-guide unit 3. Offsetting both light-guide units 2 and 3 to one another will result in offsetting the light image bottom edges LBK-L2 and LBK-L3 to one another. As a result, the light distribution emitted by the lighting device 1 has a bottom edge limiting the light distribution which is stepped, particularly according to a rectangular function.

Figure 3:
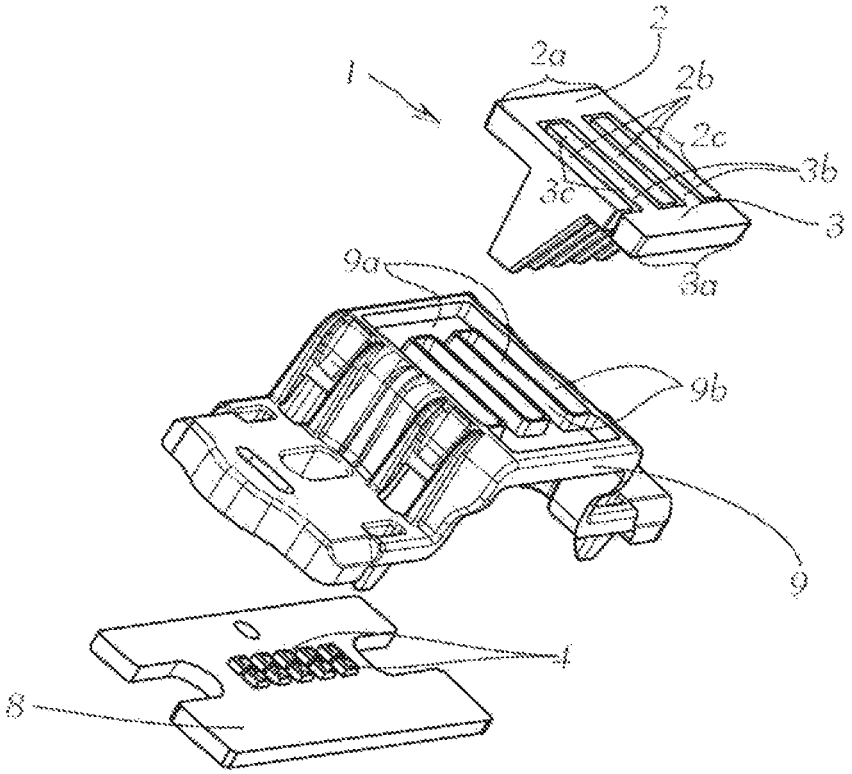
FIGS. 3 and 4 show an exemplary arrangement of individual components of a lighting device.

In order to discuss more clearly the reasons for offsetting the individual light-guide units 2 and 3 to one another, an exemplary structure of a lighting device 1 will be described below with reference to the FIGS. 3 and 4. FIG. 3 shows an exploded view of the lighting device 1, where the light sources 4 are arranged on a carrier element 8. The carrier element may be inserted into a support device 9 that, in turn, is configured to receive the light-guide units 2 and 3. For this purpose, the support device 9 also has depressions 9*a* limited by guide walls 9*b*, enabling the light-guide units 2 and 3 to be supported within the depressions 9*a*. In order to ensure the light-guide units 2 and 3 are being inserted reliably into the depressions 9*a* despite manufacturing tolerances that, for example, may be due to the manufacturing process of the light-guide units 2 and 3 and the support device 9, the depressions 9*a* typically have slightly larger dimensions than the corresponding dimensions of the light-guide units 2 and 3. Therefore, the light-guide units 2 and 3 are supported with a certain clearance within the depressions 9*a*, resulting in possible uncertainties in positioning the light-guide units 2 and 3.

Further, in FIG. 3, the first light-guide unit 2 can be easily recognised as comprising a retaining bar 2*a* having three outcoupling bars 2*b* protruding therefrom. The second light-guide unit 3 also comprises a retaining bar 3*a* having two outcoupling bars 3*b* protruding therefrom, wherein, in this case, two light sources 4 are associated with each outcoupling bar 2*b* or 3*b*. Each of the segments 6*a* and 6*b* shown in FIG. 2 is generated by the light sources 4 coupling light into the respective outcoupling bar 2*b* or 3*b* by the coupled light exiting the outcoupling bars 2*b* and 3*b* through light-outcoupling surfaces 2*c* and 3*c*, respectively, and being projected through the downstream lens 5 (see FIG. 1) onto an area in front of the lighting device 1.

Figure 4:
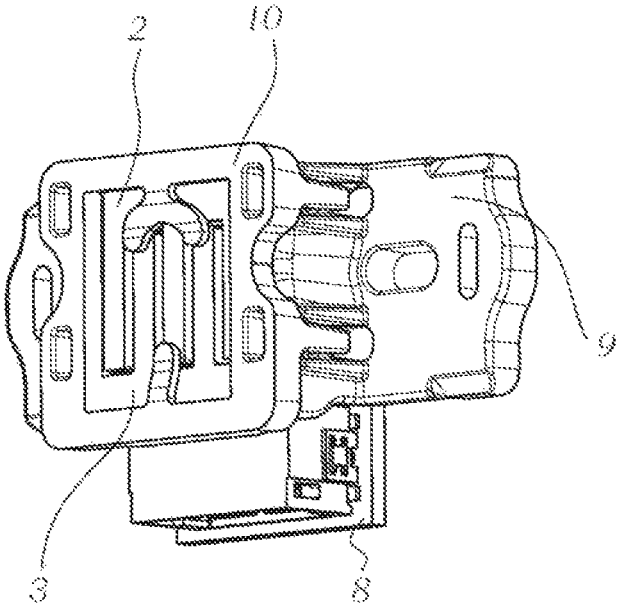

FIG. 4 shows the components of FIG. 3 when assembled, where the light-guide units 2 and 3 are secured against slipping out of the depression 9*a* by a cover not shown in FIG. 3 which is clamped on the support device 9.

Figure 5:
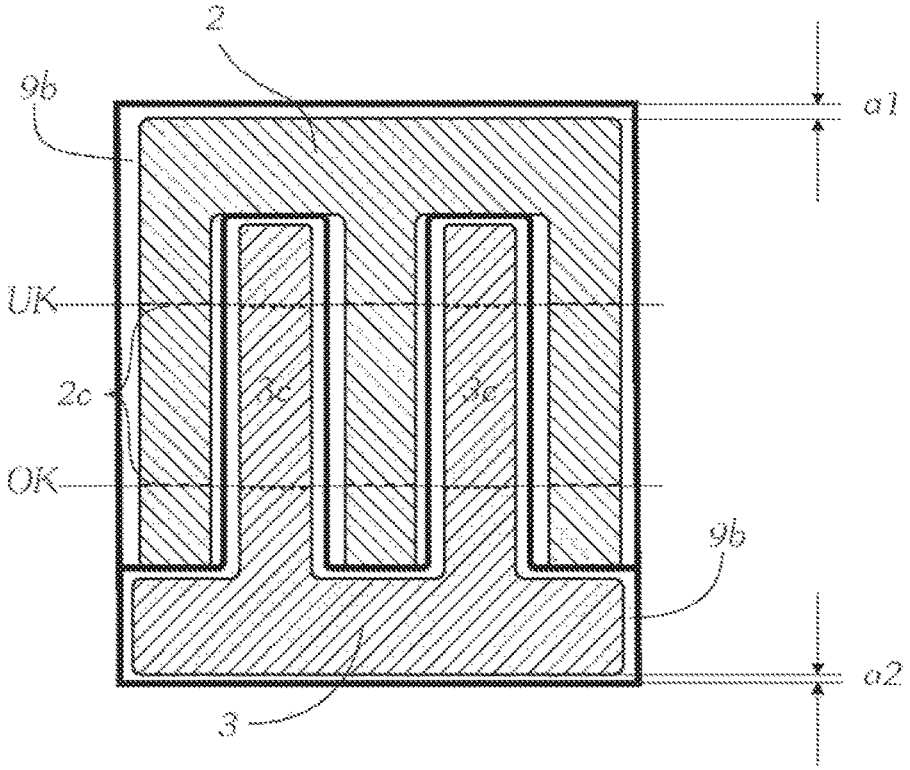
FIGS. 5 and 6 show examples of light-guide unit arrangements.
Figure 6:
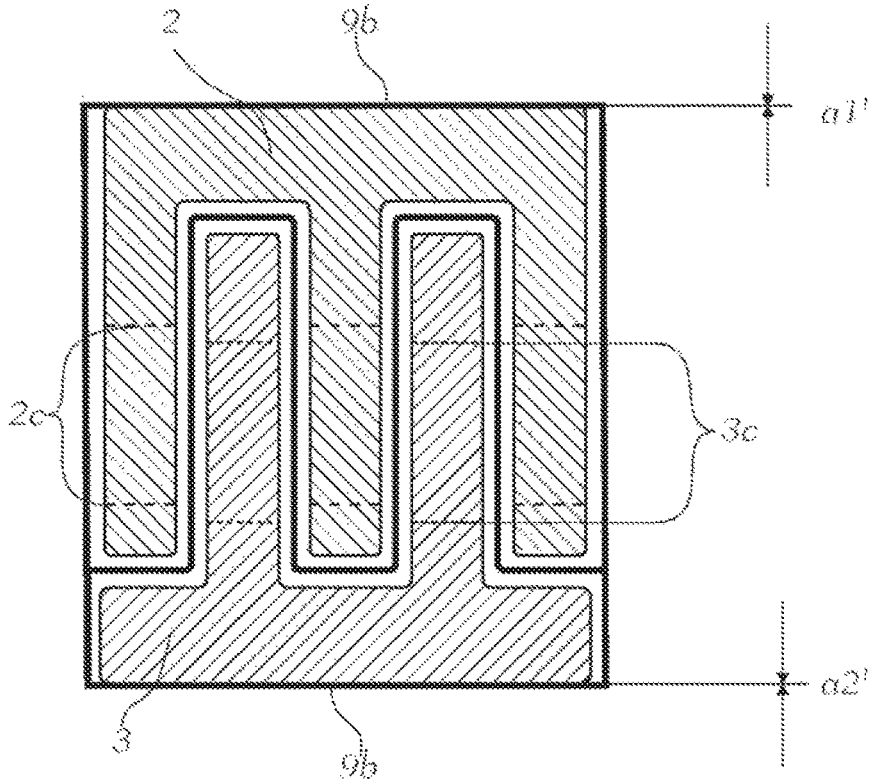

FIGS. 5 and 6 show a top view of the light-guide units 2 and 3 and their light-outcoupling surfaces 2*c* and 3*c* limited in a vertical direction by a bottom edge (Unterkante—UK) and a top edge (Oberkante—OK) indicated by dashed lines. The bottom edge UK being arranged above the top edge OK at the light-outcoupling surfaces is due to the light distribution being inverted by the downstream lens 5. In FIG. 5, the first and the second light-guide units 2 and 3 are arranged in a desired position such that the top and bottom edges OK and UK of the light exit surfaces 2*c* and 3*c* are aligned with one another. The vertical distances to the guide walls 9*b* of the support device 9 are the nominal lengths a1 and a2. By contrast, in FIG. 6, the light-guide units 2 and 3 as shown in FIGS. 1 and 2 are offset to one another, wherein the distances a1' and a2' to the side walls 9*b* are significantly reduced relative to the distances a1 and a2. As a result, contrary to the arrangement of FIG. 5, the top and bottom edges OK and UK are not aligned with one another anymore but define a rectangular function, as described above with reference to FIG. 2.

Figure 7:
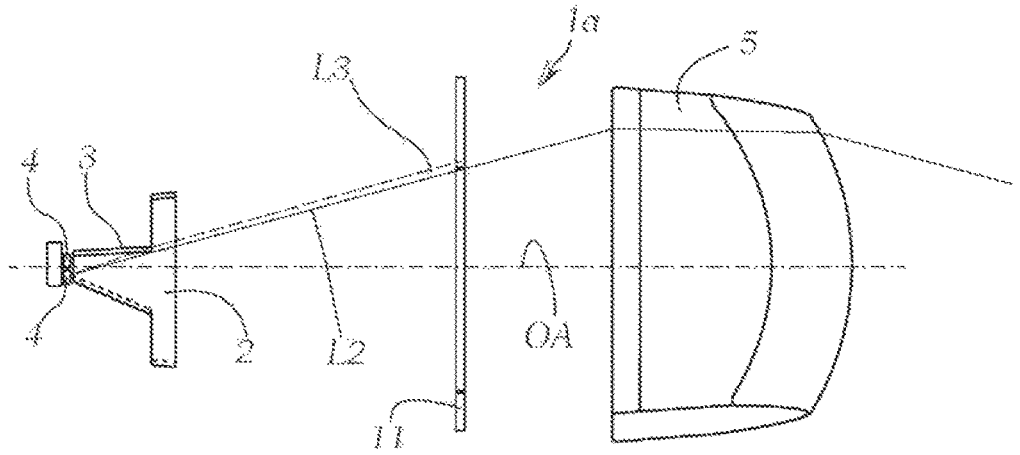
FIG. 7 shows a sectional view of an embodiment according to the invention of a lighting device and FIG. 7*a* shows a detailed view of FIG. 7.

FIG. 7 shows a sectional view of an embodiment of a lighting device 1*a* according to the invention differing from the lighting device of FIGS. 1-4 and 5, 6 by having an aperture 11 arranged between the lens 5 and the light-outcoupling surfaces 2*c* and 3*c* of the outcoupling bars 2*b*, 3*b*. The aperture 11 is configured to limit the light coupled from the outcoupling bars 2*b*, 3*b* into the lens 5 such that the light distribution emitted by the lighting device 1*a*—that is that light distribution generated by the light sources 4 via the light-outcoupling surfaces 2*c* and 3*c* through the lens 5—is limited downwards by a continuous straight bottom edge UK, preferably in the form of a horizontal line.

Figure 9:
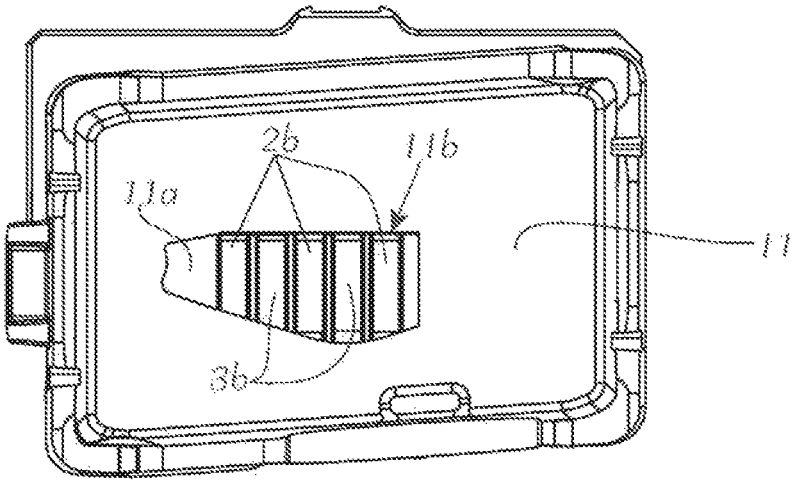
FIG. 9 shows a front view on an aperture of the lighting device.

In that instance, the aperture 11 has an opening 11*a* through which light is guided from the outcoupling bars 2*b* and 3*b* into the lens 5, wherein, when installed, an upper side of the opening 11*a* is limited by a horizontal edge (see FIG. 9). In the arrangement shown, the aperture is arranged between the light-outcoupling surfaces 2*c* and 3*c* and the lens 5 such that the solid angle illuminated from the outcoupling surfaces towards the lens 5 is restricted upwards, resulting in that the edge ray L3 described above is blocked by the aperture 11 (e.g., through absorption or reflection) and does not reach the downstream lens 5 in this example. Therefore, the area of the light-outcoupling surfaces 2*c* and 3*c* that can couple light into the lens 5 may be limited to a common solid angle. Depending on the geometric projecting properties, particularly the field curvature of the lens 5, the aperture 11 may need to be configured in a manner other than stated above in order to achieve a light distribution that is limited downwards by a continuous straight bottom edge, preferably in the form of a horizontal line.

Figure 7A:
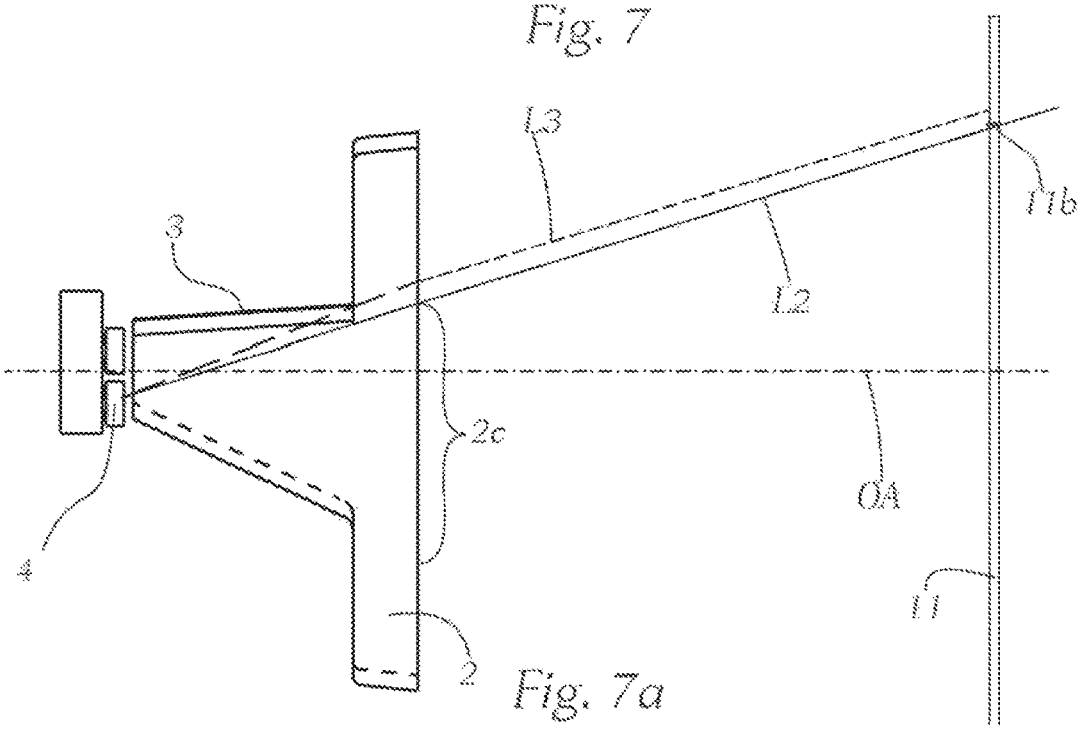
Figure 8:
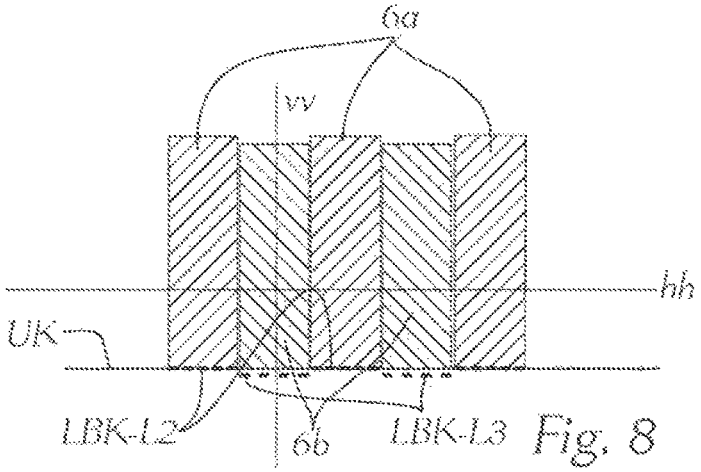
FIG. 8 shows a view of the light distribution of the lighting device of FIG. 7.

FIG. 7*a* shows a detailed view of FIG. 7, where the shape of the edge rays L2 and L3 may be recognised particularly well. FIG. 8 shows a view of the light distribution of the lighting device of FIG. 7, particularly of the light segments 6*a* of the first light-guide unit 2 and the light segments 6*b* of the second light-guide unit 3. The areas of the light segments 6*a* and 6*b* located below the bottom edge UK are blocked out by the aperture 11.

FIG. 9 shows a front view of the aperture 11 of the lighting device 1*a* covering the outcoupling bars 2*b* and 3*b* outside of the opening area 11*a*. The aperture 11 may be implemented as an integral component of a lens support supporting the lens 5, for example, as an integrally injection-moulded part. The position of the aperture may be generally set freely along the optical axis OA and preferably be selected such that, due to the position of the edge 11*b* relative to the outcoupling bars 2*b* and 3*b* and their respective emission angle, the light distribution emitted by the lens 5 is limited downwards by a single continuous straight bottom edge UK, preferably in the form of a horizontal line.

Upon review of this teaching, those skilled in the art will be able to obtain other embodiments of the invention not shown without involving an inventive step. Therefore, the invention shall not be limited to the embodiment shown. Also, individual aspects of the invention or the embodiment may be selected and combined with one another. The key element are the ideas the invention is based on that may be implemented in a variety of ways by those skilled in the art while still being maintained as such.

The invention claimed is:

1. A lighting device (1*a*) for a motor vehicle headlight comprising:

a first light-guide unit (2) having a retaining bar (2*a*) and at least two outcoupling bars (2*b*) spaced apart from one another and protruding from the retaining bar (2*a*);

a second light-guide unit (3) having a retaining bar (3*a*) and at least one outcoupling bar (3*b*) protruding from the retaining bar (3*a*);

a number of light sources (4) for coupling light into the outcoupling bars (2*b*, 3*b*) of the first and second light-guide units (2, 3), wherein at least one of the light sources (4) is associated with each of the outcoupling bars (2*b*, 3*b*); and at least one lens (5) arranged downstream of the first and second light-guide units (2, 3) for generating a light distribution, wherein each of the outcoupling bars (2*b*, 3*b*) has a light-outcoupling surface (2*c*, 3*c*) for emitting light into the at least one lens (5), wherein the first and second light-guide units (2, 3) are components separate from one another and arranged such that a respective outcoupling bar (3*b*) of the second light-guide unit (3) is arranged between neighbouring outcoupling bars (2*b*) of the first light-guide unit (2), and wherein an aperture (11) is arranged between the at least one lens (5) and the light-outcoupling surfaces (2*c*, 3*c*) of the outcoupling bars (2*b*, 3*b*) configured to limit the light coupled from the outcoupling bars (2*b*, 3*b*) into the at least one lens (5) such that the light distribution emitted by the lighting device (1*a*) is limited by a single continuous straight bottom edge (UK), wherein the aperture (11) has an opening through which light is guided from the outcoupling bars into the at least one lens, wherein, when installed, an upper side of the opening is limited by a horizontal edge.

2. The lighting device (1*a*) according to claim 1, wherein the aperture (11) is implemented integrally.

3. The lighting device (1*a*) according to claim 1, wherein the first light-guide unit (2) has a number of n outcoupling bars protruding from the retaining bar, wherein the second light-guide unit has a number of n−1 outcoupling bars protruding from the retaining bar.

4. The lighting device (1*a*) according to claim 3, wherein n=3, n=4, or n≥5.

5. The lighting device (1*a*) according to claim 1, wherein the first light-guide unit (2) has a number of n outcoupling bars protruding from the retaining bar, wherein the second light-guide unit has a number of n outcoupling bars protruding from the retaining bar.

6. The lighting device (1*a*) according to claim 5, wherein n=3, n=4, or n≥5.

7. The lighting device (1*a*) according to claim 1, wherein the first and/or second light-guide units (2, 3) are implemented as transparent solid bodies.

8. The lighting device (1*a*) according to claim 1, wherein the first and/or second light-guide units (2, 3) are implemented as light-guiding hollow bodies.

9. The lighting device (1*a*) according to claim 1, wherein at least one LED light source is associated with each outcoupling bar (2*b*, 3*b*).

10. The lighting device (1*a*) according to claim 1, wherein at least some of the light sources associated with the outcoupling bars (2*b*, 3*b*) are actuatable individually to generate a dynamic light distribution.

11. The lighting device (1*a*) according to claim 10, wherein all of the light sources associated with the outcoupling bars (2*b*, 3*b*) are actuatable individually to generate the dynamic light distribution.

12. A motor vehicle headlight comprising at least one lighting device (1*a*) according to claim 1.

13. A motor vehicle comprising at least one lighting device (1*a*) according to claim 1.

14. The lighting device (1*a*) according to claim 1, wherein all of the light sources associated with the outcoupling bars (2*b*, 3*b*) are actuatable individually to generate a dynamic light distribution.

15. A motor vehicle comprising two motor vehicle headlights, each of which comprises a lighting device (1*a*) according to claim 1.

16. The lighting device (1*a*) according to claim 1, wherein the at least one lens (5) is a projection lens.

17. The lighting device (1*a*) according to claim 1, wherein the single continuous straight bottom edge (UK) is in the form of a horizontal line.

18. The lighting device (1*a*) according to claim 1, wherein the at least one lens (5) is a projection lens and the single continuous straight bottom edge (UK) is in the form of a horizontal line.

* * * * *